US005577477A

United States Patent [19]

Katoh

[11] Patent Number: 5,577,477

[45] Date of Patent: Nov. 26, 1996

[54] FUEL SUPPLY FOR INJECTED ENGINE

[75] Inventor: Masahiko Katoh, Hamamatsu, Japan

[73] Assignee: Sanshin Kogyo Kabushiki Kaisha, Hamamatsu, Japan

[21] Appl. No.: 502,911

[22] Filed: Jul. 17, 1995

[30] Foreign Application Priority Data

Jul. 15, 1994 [JP] Japan ..... 6-163846
Oct. 26, 1994 [JP] Japan ..... 6-262356

[51] Int. Cl.[6] ..... F02M 51/00

[52] U.S. Cl. ..... 123/456; 123/472

[58] Field of Search ..... 123/456, 468, 123/469, 470, 472, 184.45

[56] References Cited

U.S. PATENT DOCUMENTS

| | | | |
|---|---|---|---|
| 4,307,693 | 12/1981 | Glockler et al. | 123/470 |
| 4,516,555 | 5/1985 | Shioya et al. | 123/470 |
| 4,570,602 | 2/1986 | Atkins et al. | 123/456 |
| 4,702,202 | 10/1987 | Hensel | 123/456 |
| 5,022,371 | 6/1991 | Daly | 123/184.45 |
| 5,040,512 | 8/1991 | Twilton | 123/456 |
| 5,074,269 | 12/1991 | Herbon et al. | 123/456 |
| 5,101,792 | 4/1992 | Koch | 123/456 |
| 5,168,856 | 12/1992 | Lorraine | 123/456 |
| 5,197,436 | 3/1993 | Ozawa | 123/456 |
| 5,445,130 | 8/1995 | Brummer et al. | 123/456 |

*Primary Examiner*—Thomas N. Moulis
*Attorney, Agent, or Firm*—Knobbe, Martens, Olson & Bear

[57] ABSTRACT

A number of embodiments of fuel injection systems, particularly adapted for use with multiple cylinder V-type engines to ensure that the fuel injectors can all be appropriately positioned and each supplied with a steady source of fuel under pressure. An improved mounting arrangements is also disclosed wherein the fuel rails are rigidly affixed to the throttle bodies so as to hold the fuel injectors in place.

18 Claims, 12 Drawing Sheets

FUEL SUPPLY FOR INJECTED ENGINE

BACKGROUND OF THE INVENTION

This invention relates to a fuel supply for an injected engine and more particularly to an improved fuel supply system for fuel injected engines, and particularly those of the V-type.

As is well known, fuel injected engines normally employ a device referred to as a "fuel rail" that supplies the fuel to the individual injectors. Generally, these fuel rails receive fuel under pressure from the fuel source and have a return line in which a pressure regulator is positioned so as to regulate the pressure at which the fuel is supplied to the individual injectors. Although such an arrangement is practical for in-line type engines wherein the fuel injectors may all be positioned in a row, this system is not as practical with V-type engines. This is particularly true when the fuel injectors for the individual cylinders are not aligned with each other, a common occurrence with V-type engines.

It is, therefore, a principle object of this invention to provide an improved fuel supply arrangement for V-type engines.

It is a further object of this invention to provide an improved and simplified fuel supply arrangement for the fuel injectors of a V-type engine that permits the injectors to be positioned at their optimum locations.

As should be obvious from the foregoing description, with fuel injected engines, it is extremely important that the fuel supply to the injectors be at a uniform and desired pressure. Where multiple injectors are supplied by a common fuel rail, this can be difficult. In fact, where V-type engines are employed, it is even more to difficult to ensure that each injector receives fuel at the same fuel pressure. This problem is aggravated when adjacent injectors are called upon to inject fuel either at the same time or immediately adjacent each other in the injection timing.

It is, therefore, a still further object of this invention to provide an improved fuel supply system for an engine having multiple injectors that insures that the pressure of the fuel supply to the individual injectors will be uniform and not adversely influenced by the injector firing order.

As has been discussed, it is the normal practice to mount the fuel injector to the engine and to supply fuel to the individual injectors through a fuel rail. These fuel rails are normally mounted on the injectors. This presents some problems For example, it is frequently the practice to have injector mounted somewhat resiliently in the intake manifold or cylinder head into which it sprays. The retention is frequently done merely by an elastic seal. If the fuel rail is mounted on the injectors and supported solely by them, then vibrations can cause the injectors to work loose from the engine itself. This problem is even more prevalent if the fuel rail also carries additional auxiliary such as pressure regulators, etc.

It is, therefore, a still further object to this invention to provide an improved mounting arrangement for a fuel injector and its fuel supplying fuel rail.

SUMMARY OF THE INVENTION

A first feature of this invention is adapted to be embodied in a fuel injection system for an internal combustion engine having a throttle body assembly with a plurality of pairs of induction passages. A plurality of pairs of fuel injectors are each mounted in the throttle body assembly and are supposed to spray fuel into a respective induction passage. A fuel supply system supplies fuel to the fuel injectors. The fuel supply system includes a first manifold section extending along one side of at least some of the induction passages for supplying fuel to the fuel injectors associated with those induction passages. A second manifold section is spaced from the first manifold section and extends along another side of other of the induction passages for supplying fuel to the fuel injectors associated with these other induction passages.

Another feature of the invention is adapted to be embodied in a fuel injection system for an internal combustion engine having a manifold assembly with an opening into which the nozzle portion of a fuel injector is fitted. A fuel rail is detachably connected to the end of the fuel injector remote from the nozzle portion for supplying fuel to it. The fuel rail is rigidly fixed to the manifold section to assist in retaining the fuel injector in the manifold section.

DETAILED DESCRIPTION OF THE PREFERRED EMBODIMENTS OF THE INVENTION

Figure 1:
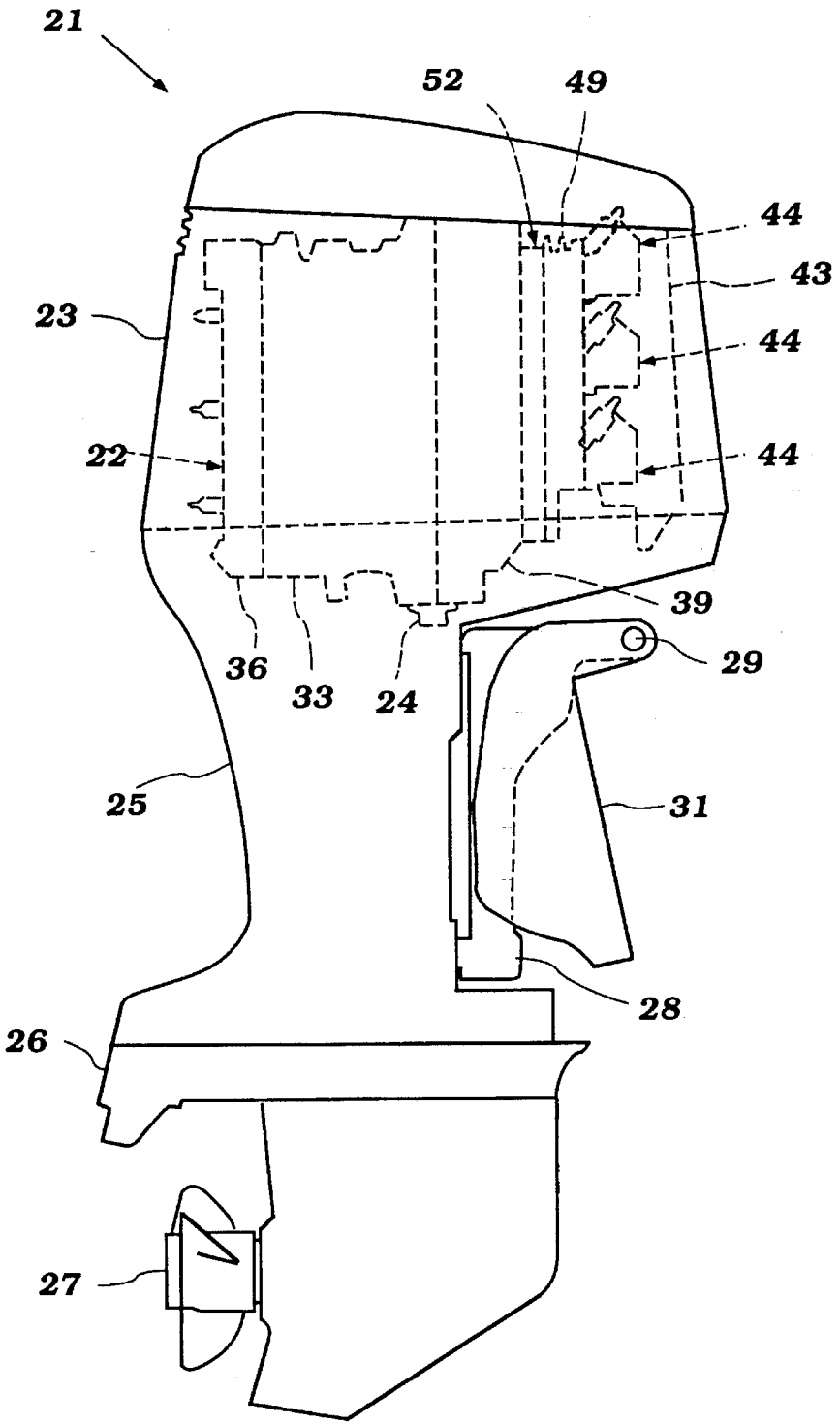
FIG. 1 is a side elevational view of an outboard motor constructed in accordance an embodiment of the invention.

Referring now in detail to the drawings and initially to the embodiment of FIGS. 1 through 4, and initial primarily to FIG. 1, an outboard motor constructed in accordance with this embodiment is identified generally by the referenced numeral 21. The invention is described in conjunction with an outboard motor, although its application is not so limited, because outboard motors frequently employ fuel injection systems and have V-type engines, a area where the invention has particular utility.

The outboard motor 21 is comprised of a power head that consists of a powering internal combustion engine, indicated generally by the referenced numeral 22 and a surrounding protective cowling 23. The cowling 23, as is well known in this art, generally is comprised of a lower tray portion and an upper main cowling portion which are detachably connected to each other. However, since the invention relates to the construction of the engine 23 and specifically its induction and fuel injection system, further description of the details of the protective cowling are not necessary to understand the invention.

As is typical in outboard motor practice, the engine 22 is mounted in the cowling 23 so that its output or crankshaft 24 rotates about a vertically extending axis. This facilitates attachment to a drive shaft (not shown) which is journaled for rotation about a coincident, vertically extending axis within a drive shaft housing 25. This drive shaft then extends on to a lower unit 26 where it drives a propeller 27 through a known type of forward neutral reverse transmission (not shown).

The outboard motor 21 also includes the normal swivel bracket 28 which journals a steering shaft fixed to the drive shaft housing 25 for steering of the outboard motor 21 about this axis in a known manner. The swivel bracket 28 is connected pivotally by means of a pivot pin 29 to a clamping bracket 31. The clamping bracket 31 is adapted to be detachably affixed to the hull of an associated water craft. The pivotal connection provided by the pivot pin 29 permits tilt and trim movement, as is also well known in this art.

Figure 2:
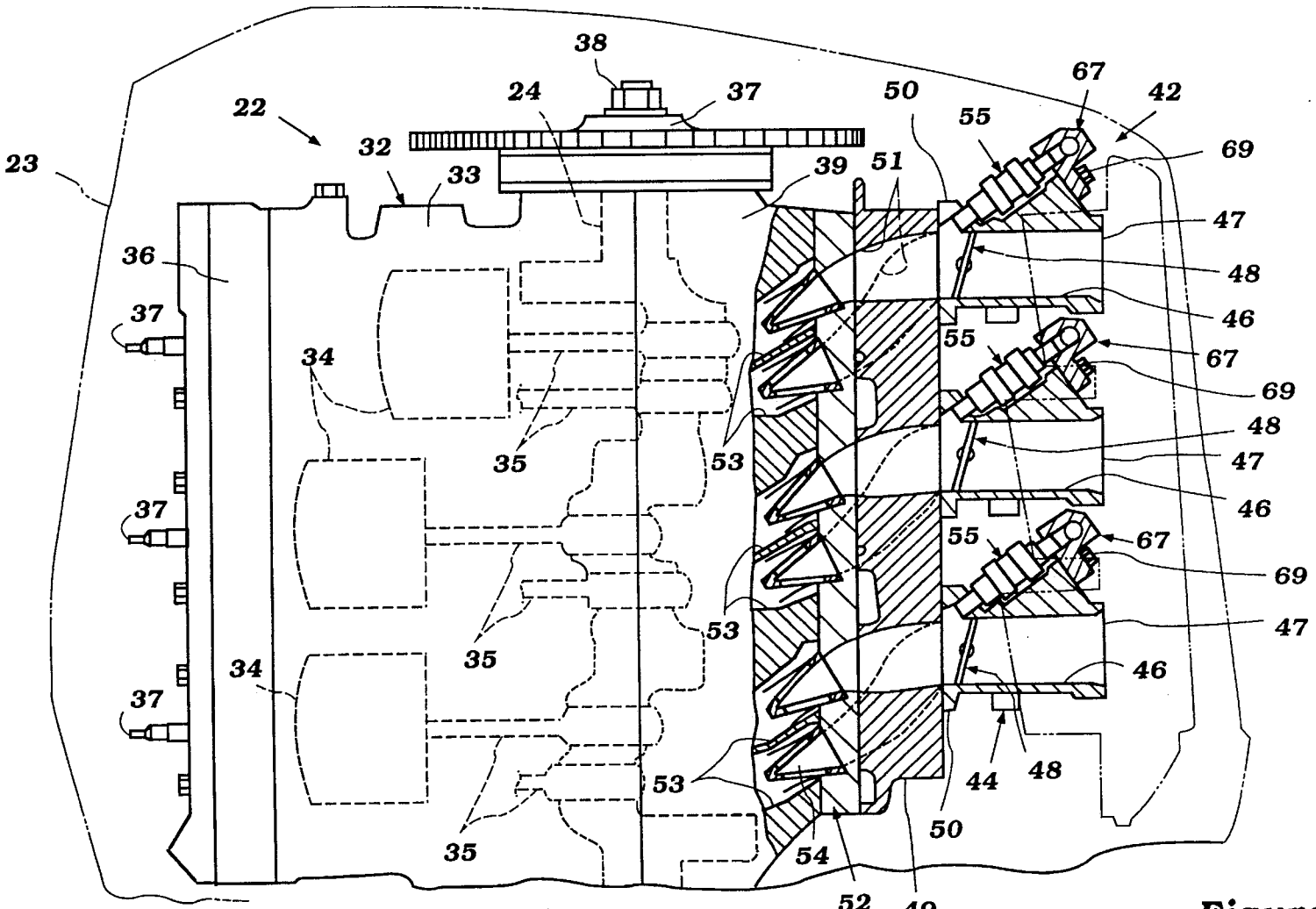
FIG. 2 is an enlarged view of the power head of the outboard motor with the protective cowling shown in phantom and portions broken away and shown in a section taken along the line 2—2 of FIG. 3.
Figure 3:
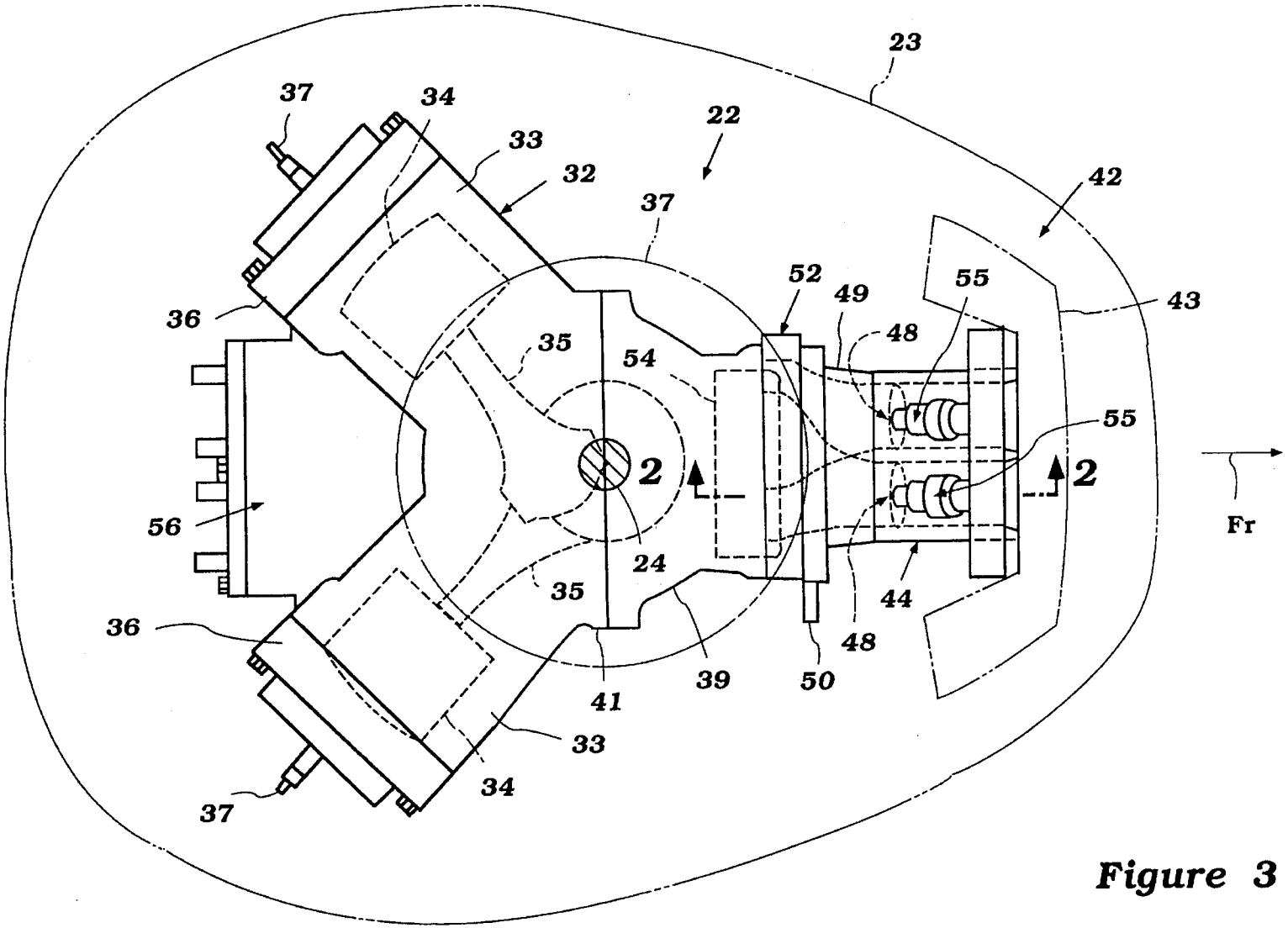
FIG. 3 is a top plan view of the structure shown in FIG. 2 again with the protected cowling being shown in phantom, but with no portions broken away.

Referring now in additional detail to FIGS. 2 and 3, the engine 22 is depicted as being of the V-6 type and operates on a two-cycle crankcase compression principle. Although the invention is described in conjunction with V-type engines and engines operating on the two-stroke crankcase compression principle, it will be readily apparent to those skilled in the art how the invention may be applied with engines operating on other principles such as four-stroke engines and also engines having other cylinder configurations. Certain facets of the invention, however, have particular utility with V-type engines for reasons which will become apparent.

The engine 22 is comprised of a cylinder block, indicated generally by the referenced numeral 32 and which has a pair of angularly disposed cylinder banks 33. Each cylinder bank 33 is formed with three in-line cylinder bores and pistons 34 are slidably supported in the cylinder bores of each cylinder bank 33. The pistons 34 are, in turn, connected to connecting rods 35 by piston pins (not shown). The lower or big ends of the connecting rods 35 are journaled on the crankshaft 24 in side-by-side paired relationship, as is typical in V-type engine practice. To accomplish this, the cylinder banks 33 are staggered relative to each so that the pairs of cylinder bores are not in the same plane, but slightly offset so as to permit the side-by-side relationship of the connecting rods 35 on the throws of the crankshaft 24.

Cylinder heads 36 are affixed in a known manner to the cylinder block banks 33. The cylinder heads 36 have recesses which cooperate with the heads of the pistons 34 and the cylinder bores to from the combustion chambers of the engine. Spark plugs 37 are mounted in the cylinder heads 36 and have their gaps each extending into a respective one of the recesses for firing the fuel air charge inducted thereto. The spark plugs 37 are fired by a suitable ignition system which may be of any known type and which includes a flywheel magneto assembly 37 that is affixed to the upper end of the crankshaft 24 by means of a threaded fastener 38.

The crankshaft 24 is rotatably journaled within a crankcase chamber formed by a crankcase number 39 and a skirt portion 41 of the cylinder block 32. The crankcase number 39 is affixed to the skirt 41 in any known manner. As is typical with two-cycle crankcase compression engine practice, the portions of the crankcase chamber associated with each of the cylinder bores are sealed from each other in any known manner.

A fuel air charge is delivered to these crankcase chambers by means of an induction and charge forming system, indicated generally by the reference numeral 42. This includes an air inlet device, which may be of any known configuration and which is shown in phantom and identified by the referenced numeral 43. This air inlet device 43 draws air that has been admitted to the protective cowling 23 through a suitable air inlet system. This air is then delivered to a throttle body assembly, indicated generally by the reference numeral 44 which is comprised of a plurality of pairs of throttle bodies 45 each of which defines a pair of adjacent intake passages 46. These intake passages 46 have respective inlet openings 47 that open into the interior of the air inlet device 43 which is affixed to the throttle bodies 44 in a known manner. Each throttle body 44 has in its induction passage 46 a respective throttle valve 48. The throttle valves 48 are all interconnected by means of a suitable linkage system which will be described later so that the throttle valves 48 will be opened and closed in synchronism.

Although the illustrated embodiment shows three individual sets of paired throttle bodies 45, it will be understood by those skilled in the art that the throttle bodies 44 may be comprised of a unitary assembly having pluralities of pairs of intake passages 46.

The throttle bodies 44 have flanges 50 that are affixed to an intake manifold 49 which is provided with, pairs of intake passages 51 which are complimentary to and have their inlet openings aligned with the discharge ends of the throttle body intake passages 46.

The intake manifold 49 and throttle bodies 44 are affixed to a read valve assembly, indicated generally by the reference numeral 52 and which is itself provided with a plurality of intake passages 53 which are paired and each of which communicates with a respective one of the afore-noted crankcase chambers. Reed type check valves 54 are carried by the reed valve assembly 52 and permit the flow of the intake charge into the crankcase chambers when the pistons 34 are moving upwardly, but preclude reverse flow as the pistons 34 move downwardly to compress the charge in the crankcase chambers.

A plurality of pairs of electronic fuel injectors, each indicated by the reference numeral 54 are mounted in the throttle bodies 44 preferably in a manner which will be described. These fuel injectors 54 are mounted so that they spray into the throttle bodies 44 downstream of the idle or closed positions of the throttle valves 48 and toward the manifold intakes passages 51. Fuel is supplied to the fuel injectors 55 in a manner which will be described.

The fuel air charge which is inducted into the crankcase chambers in the manner described and compressed therein by the pistons 34 is subsequently transferred to the combustion chambers of the engine. A suitable scavenging system (not shown) is provided for this purpose. This charge is then further compressed in the combustion chambers and fired by the spark plugs 37. The burnt charge is then discharged through an exhaust system that includes an exhaust manifold, indicated generally by the reference numeral 56 and which is formed in the valley between the cylinder banks 33. These exhaust gases are then discharged outwardly into the drive shaft housing 25 for discharge to the atmosphere through a suitable exhaust system of the type well known in the outboard motor field.

The construction of the engine 22 as thus far described may, as had been noted, be considered a conventional. The invention deals with the way in which the fuel is supplied to the fuel injectors 55 and also the way in which the injectors 55 are mounted. A first embodiment of the invention will be described now by particular reference FIGS. 2 and 4.

Figure 4:
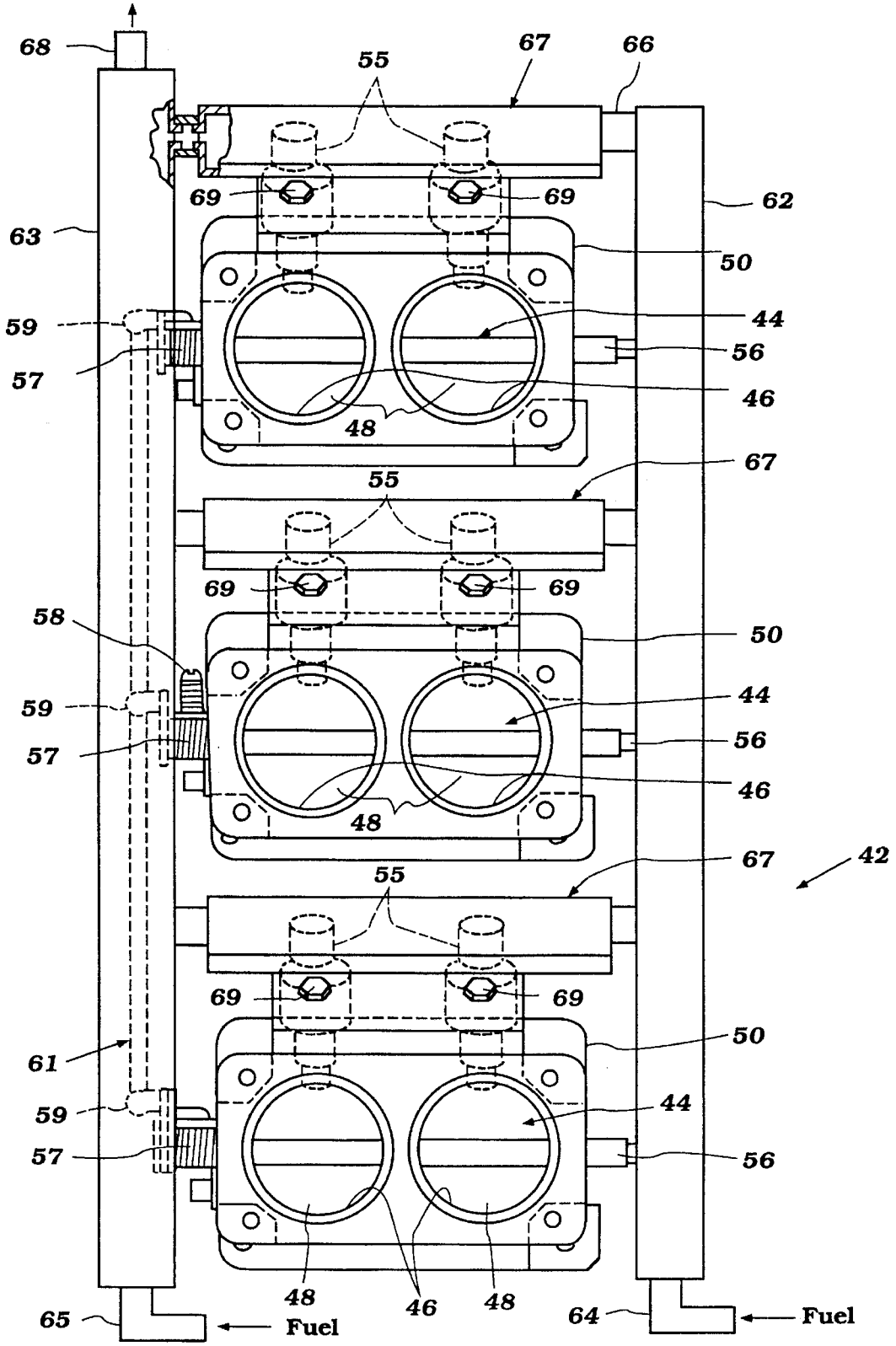
FIG. 4 is an enlarged view taken in the direction of the arrow 4 in FIG. 2 and shows the relationship of the throttle body fuel injectors and fuel supply system therefor.

Before describing this system, however, it will be noted that FIG. 4 shows that each of the throttle valves 48 of each pair is affixed to a respective throttle valve shaft 56 that is journaled within the respective throttle body portion. At one side thereof, torsional springs 57 are loaded and urge the throttle valves 48 to their closed or idle position. This position is set by an idle stop screw 58 that cooperates with a throttle link 59 affixed to the respective throttle valve shaft 56. As has been noted, the throttle valve and specifically their links 59 are all connected to each other by a linkage system shown in this figure and identified by the reference numeral 61.

Referring now to the fuel supply system for supplying fuel to the fuel injectors 55, in this embodiment the fuel supply system includes a pair of main fuel manifolds 62 and 63 each positioned on a respective outer side of the throttle body portions 44. In this embodiment, the manifold sections 62 and 63 extend beyond the ends of the throttle body portions 44. One or specifically the lower ends of the manifolds 62 and 63 are provided with inlet fittings 64 and 65 to which fuel is supplied from a high pressure source as indicated by the arrows in FIG. 4.

This fuel is then delivered through respective pairs of elastic couplings 66 to transversely extending fuel manifolds 67. The transversely extending fuel manifolds 67 provide an open flow path, in this embodiment, between the longitudinally extending manifolds 62 and 63. These manifolds 67 also have suitable receptacles to receive the fuel delivery ends of the fuel injectors 55 so as to deliver the fuel thereto.

In this embodiment, the manifold section 62 is opposite the inlet 64 in closed. A fitting 68 is provided on the manifold 63 and this is connected to a pressure regulator for regulating the fuel pressure in each of the manifolds 62 and 63, and the cross-manifold 69. Hence, the fuel pressure supplied to each of the injectors 55 will be uniform.

As may be best seen in FIG. 2, each cross-manifold 67 is secured by means of a pair of threaded fasteners 69 directly to the throttle body portion 44. This rigidifies the total connection of the fuel injectors 55 to the throttle bodies 44 and/or manifold 49. Thus, it is unlikely that the fuel injectors 55 may work free from the induction system as a result of this connection.

Figure 5:
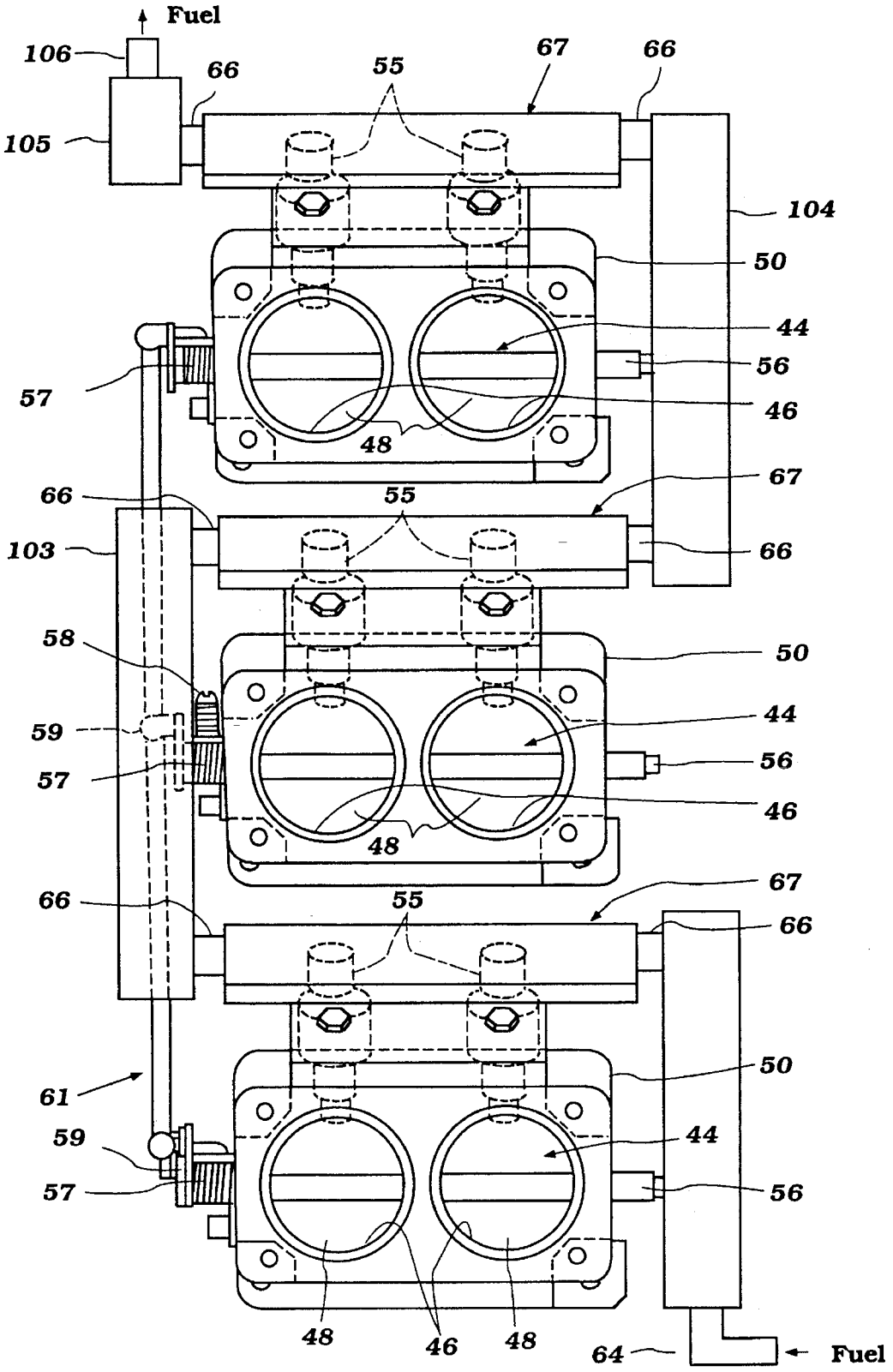
FIG. 5 is an enlarged view, in part similar to FIG. 4, and shows another embodiment of the invention.

FIG. 5 shows another embodiment of the invention which differs from the embodiment of FIG. 4 only in the manifolding arrangement. For this reason, only a single figure is believed to be necessary to illustrate this embodiment. Thus, where components are the same or substantially the same as those previously described, they have been identified by the same reference numerals and will be described again only insofar as is necessary to understand the construction and operation of this embodiment.

Basically, this embodiment differs from the previously described embodiment in that that previous embodiment of FIG. 4 may be deemed to represent a parallel fuel flow path to the individual fuel injectors 55 while this embodiment shows what could be considered a series flow arrangement. Hence, each pair of fuel injectors 55 is still served by the respective cross-manifold 67. However, there is provided a first supply manifold 101 which has an inlet fitting 102 that receives fuel from the high pressure source. This first side manifold 101 directly serves only the lowermost cross-manifold 67 through a connector 66 as previously described.

The opposite side of the cross-manifold 67 is connected by a connector 66 to a second longitudinally extending manifold 103 that is dispose on the opposite side of the throttle bodies portions 44 and which spans the lowermost cross-manifold 67 and the center cross-manifold 67.

The cross-manifold 67 of this middle throttle body portion 44 has it opposite end connected by a connector 166 to a third longitudinally or vertically extending side manifold 104. This manifold 104 has at its opposite end a connection 66 to the uppermost cross-manifold 67.

A short L fitting 105 is connected by a coupling 66 to the opposite side of the cross-manifold 67 and has a fitting 106 for connection to the pressure regulating circuit.

Figure 6:
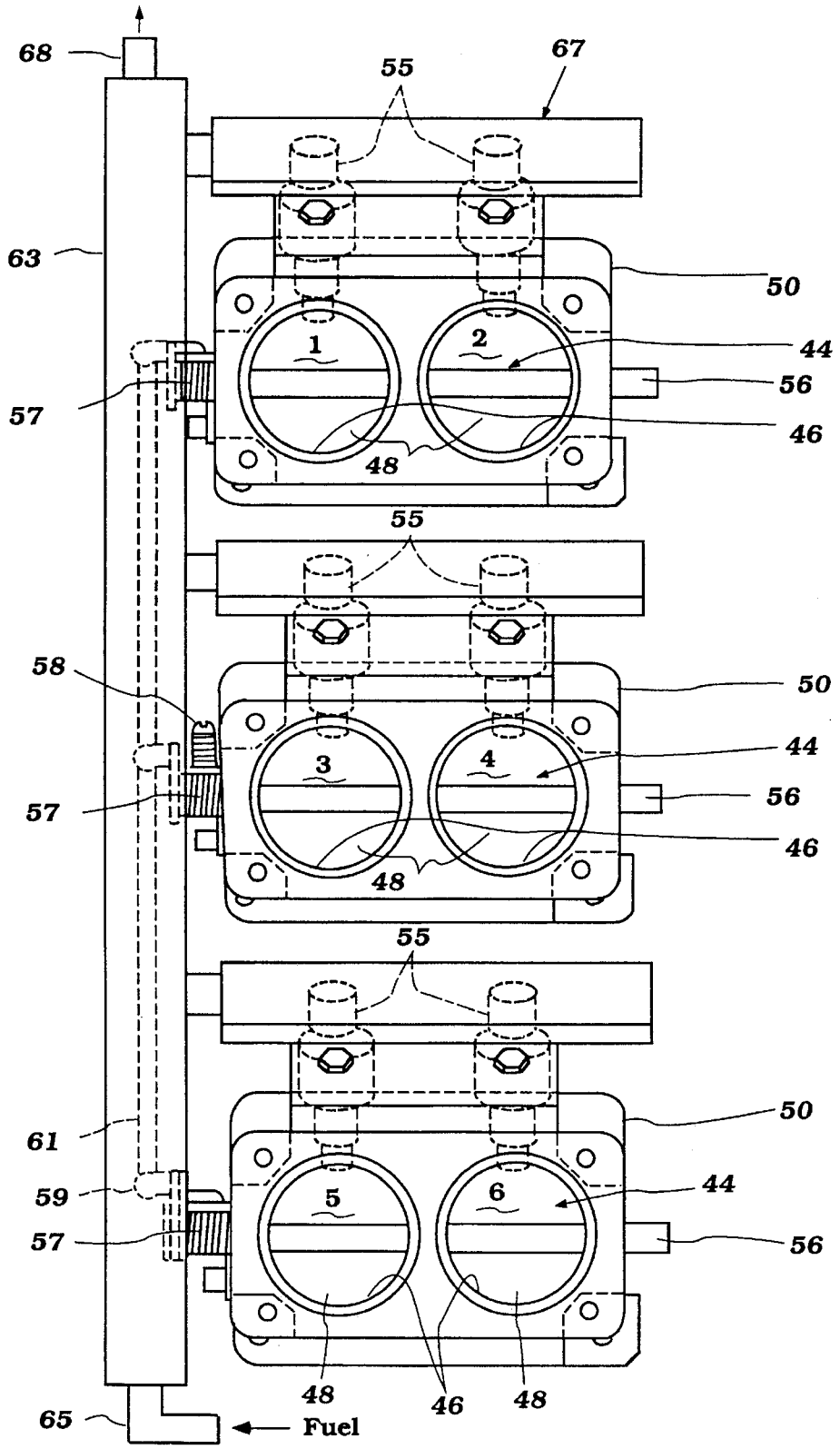
FIG. 6 is an enlarged view, in part similar to FIGS. 4 and 5, and shows yet another embodiment of the invention.

FIG. 6 shows another embodiment and this embodiment is the same as the embodiment of FIG. 4 only the first side manifold section 62 is completely deleted and, hence, the cross-manifolds 67 only communicate with the single side manifold 63. Since this is the only difference, all reference numerals employed in embodiment of FIG. 4 have been applied to this embodiment.

Figure 7:
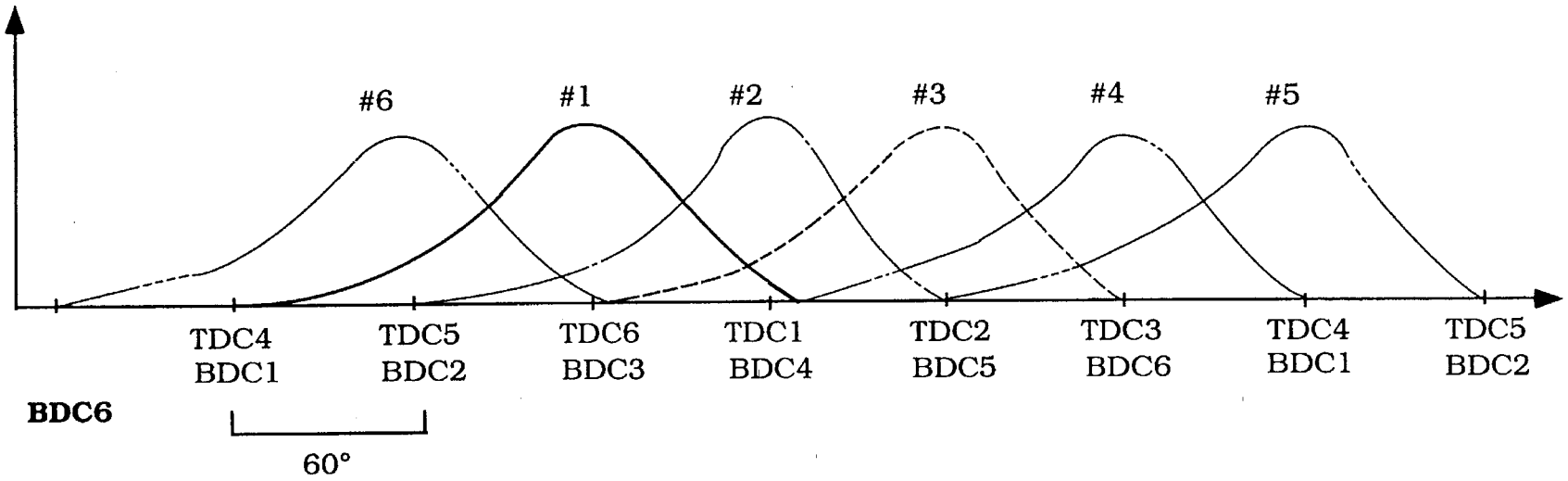
FIG. 7 is a graphical view showing the read valve openings associated with the individual cylinders of the engine so as to explain the basis for certain additional embodiments of the invention.

A disadvantage with the type of structure as shown in FIG. 6 may be understood by reference to FIG. 7 which shows the reed valve openings for each of the cylinders having a cylinder firing order 1, 2, 3, 4, 5, 6 with the cylinder numbers being alternated from top to bottom and one bank to the other. These cylinder numbers are indicated on the throttle valves of FIG. 6. It will seen that because of the overlapping of the time when the intake cycle is taking place, there will be some possible overlapping between the time when the respective injectors served by each cross-manifold 67 are firing. This could result in some pressure drop and next will be described a number of embodiments wherein the individual injectors 55 of each throttle body portion are supplied route with fuel under pressure relatively independently of each other.

Figure 8:
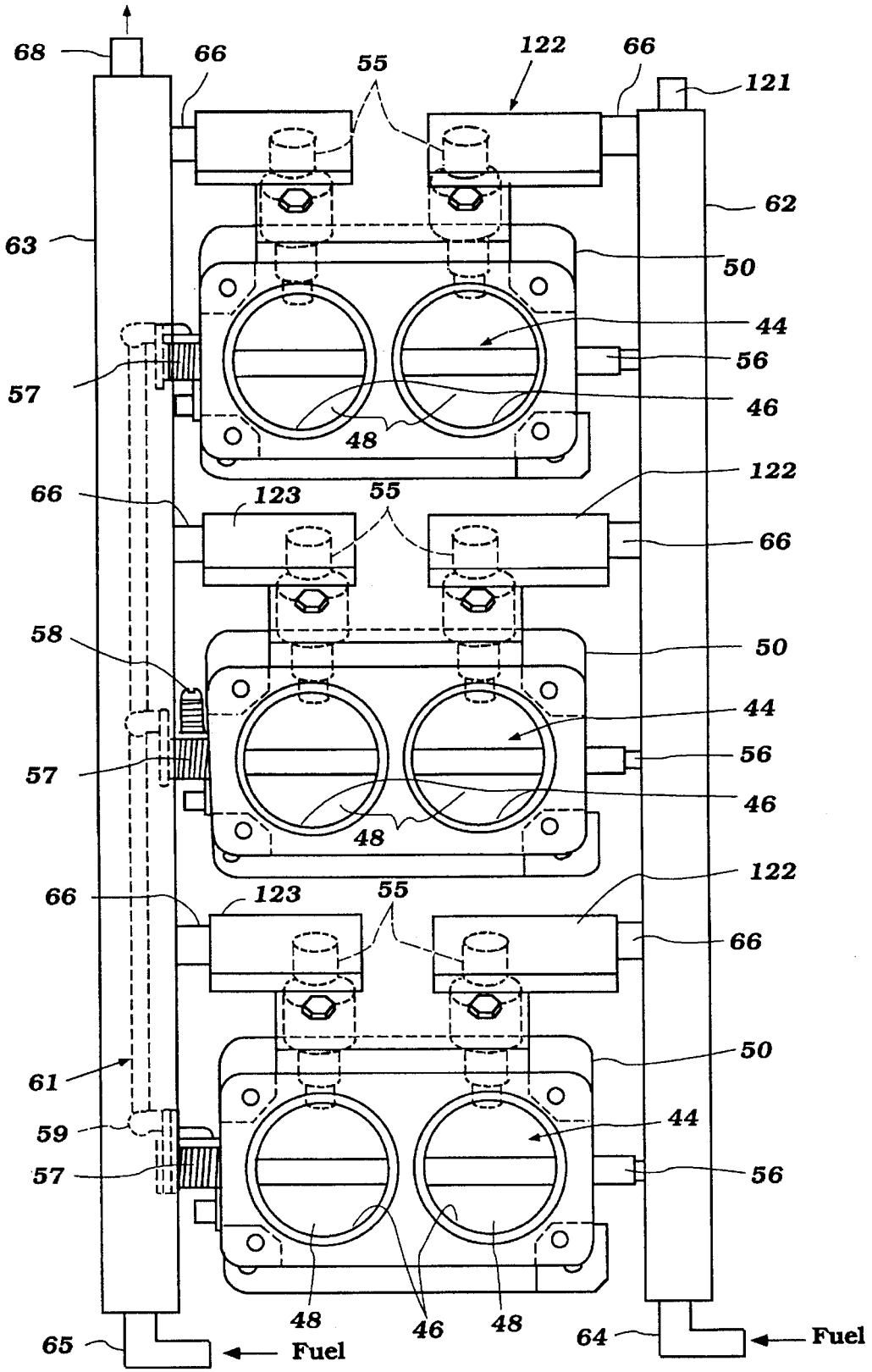
FIG. 8 is a view, in part similar to FIGS. 4 through 6, and shows yet another embodiment of the invention.

The first of these embodiments appears in FIG. 8 and this employs the side manifold section as previously described in conjunction with FIG. 4 and, hence, these manifold sections 62 and 63 are identified by the same reference numerals. However, in this embodiment, each section is provided with a respective return fitting. The section 63 utilizes the return fitting 68 as previously described while the manifold section 62 employs a return fitting 121 that is connected to either the same or a different pressure regulator than the return fitting 68. The manifold section 68 serves one fuel injector 55 of each throttle body pair through a series of respective cross-connectors 122, each of which is connected to the side manifold section 62 by a flexible connection 66.

In a similar manner, the manifold section 63 serves the remaining fuel injector 155 of the throttle body pairs through respective cross-manifolds 123. These cross-manifolds 123 are also connected to the side manifold section 63 through flexible connector 66. Hence, the fuel supply for the injector 55 of each pair are substantially independent of each other with this embodiment and the discharge of one injector 55 will not affect the pressure available to the other injector of the pair.

Figure 9:
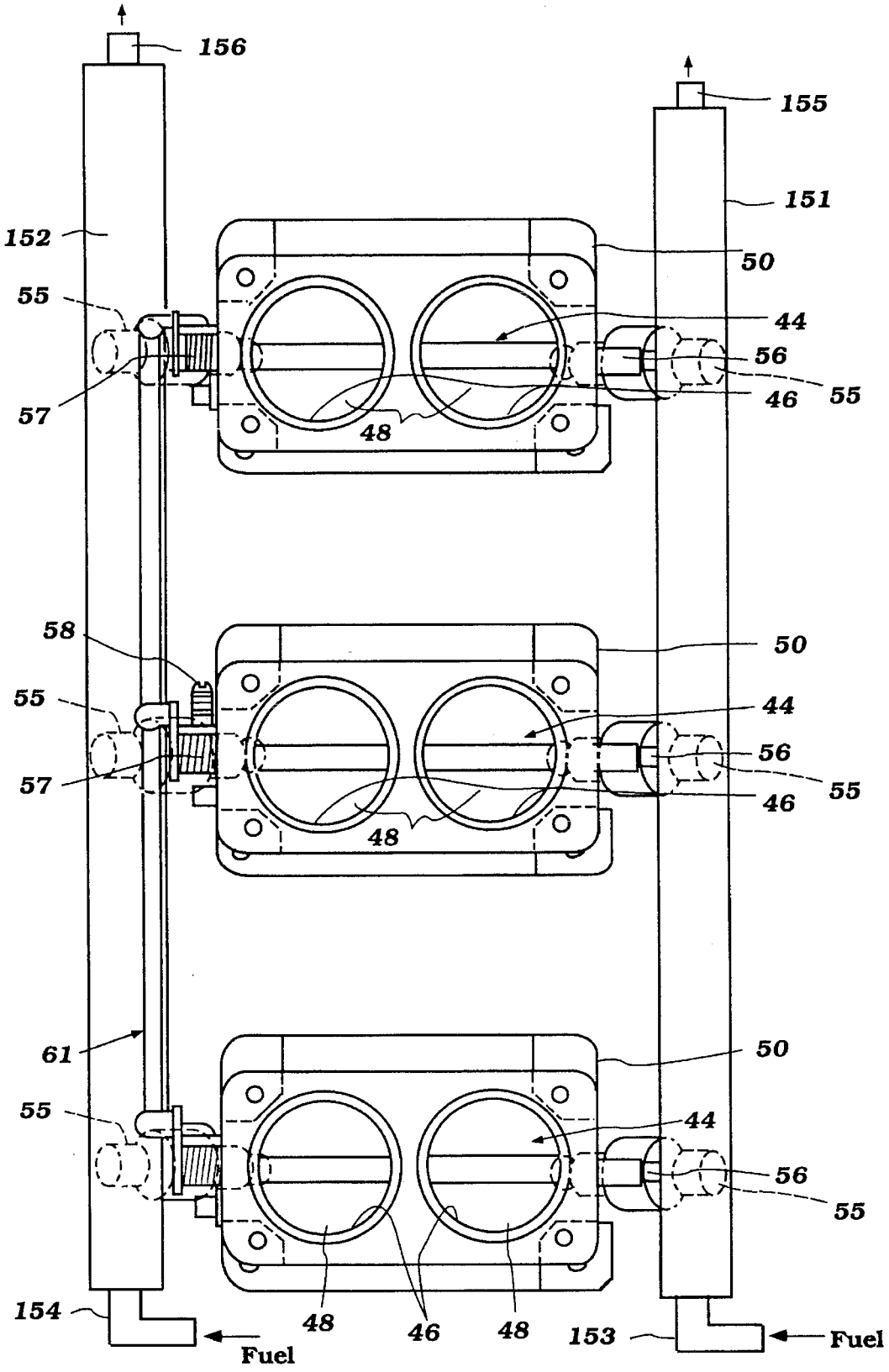
FIG. 9 is a view, in part similar to FIGS. 4 through 6, and 8, and shows a still further embodiment of the invention.

FIG. 9 shows another embodiment that permits the attainment of this result. In all of the embodiments that are thus far described, the fuel injectors 55 have been provided on the same sides of the throttle body sections 44. In this embodiment, the pair of fuel injectors 55 each serve opposite sides and extend generally parallel to the throttle valve shafts 56. However, their spray pattern into the intake passages 46 are substantially the same. Hence, only a pair of side manifolds sections 151 and 152 are required each of which has its own fuel inlet fitting 153 and 154 and its own regulated discharge fitting 155 and 156. No cross-manifolds are required with this arrangement.

Figure 10:
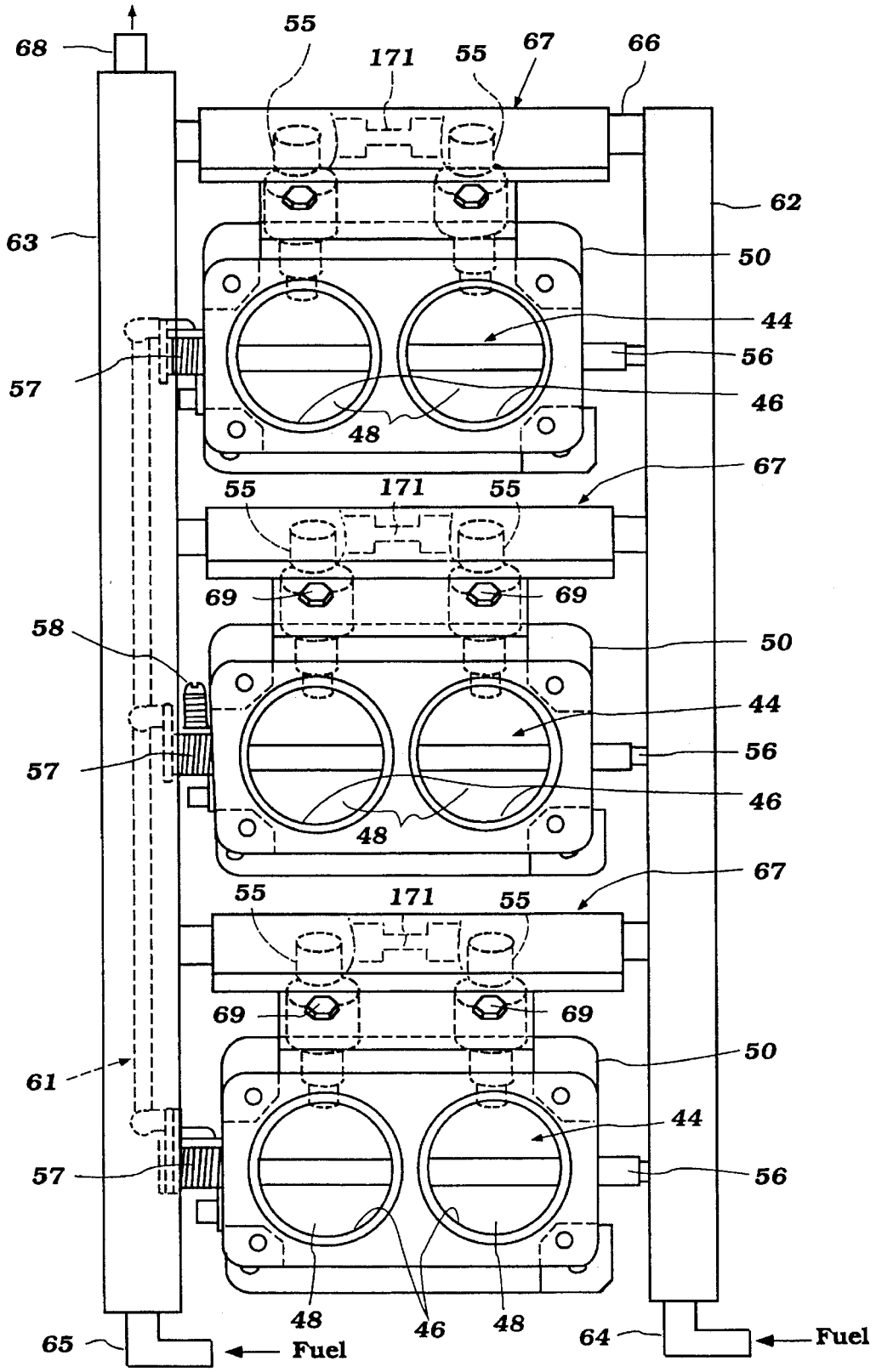
FIG. 10 is a view, in part similar to FIGS. 4 through 6, 8 and 9, and shows still another embodiment of the invention.

FIG. 10 shows another embodiment that achieves this result using a construction of the type shown in FIG. 4. Because of the similarities to that earlier embodiment, the components of this embodiment which are the same as it have been identified by the same reference numerals. In this embodiment, each cross-manifold 67 is provide with a respective fuel restricting orifice portion 171 which restricts the cross-flow from the side manifold sections 62 and 63 toward each other. This also serves to dampen pressure variations of one of the injectors 55 from the other injector of the respective throttle body pair.

Figure 11:
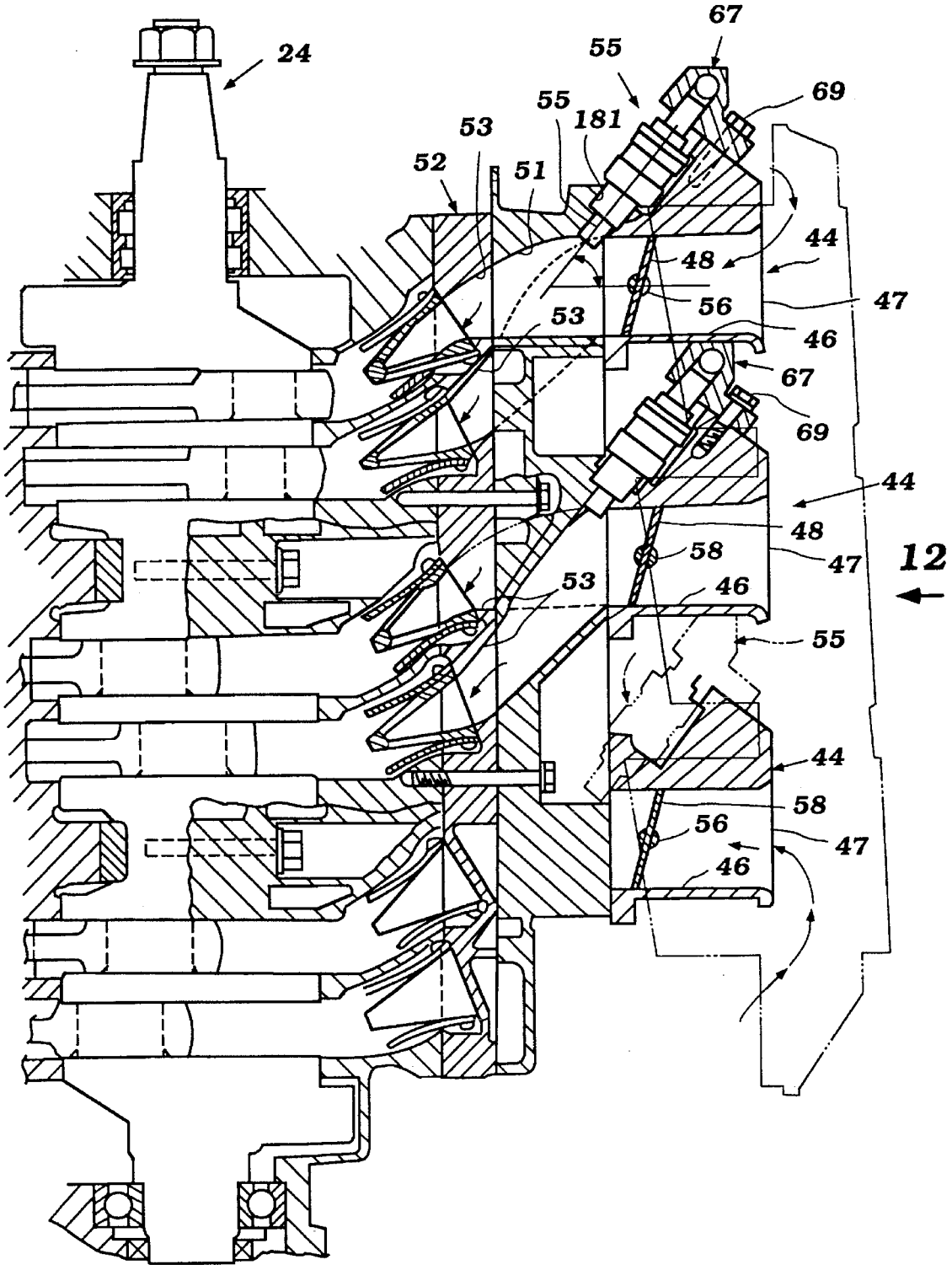
FIG. 11 is a cross-sectional view, in part similar to FIG. 2, but shows another embodiment of invention.
Figure 12:
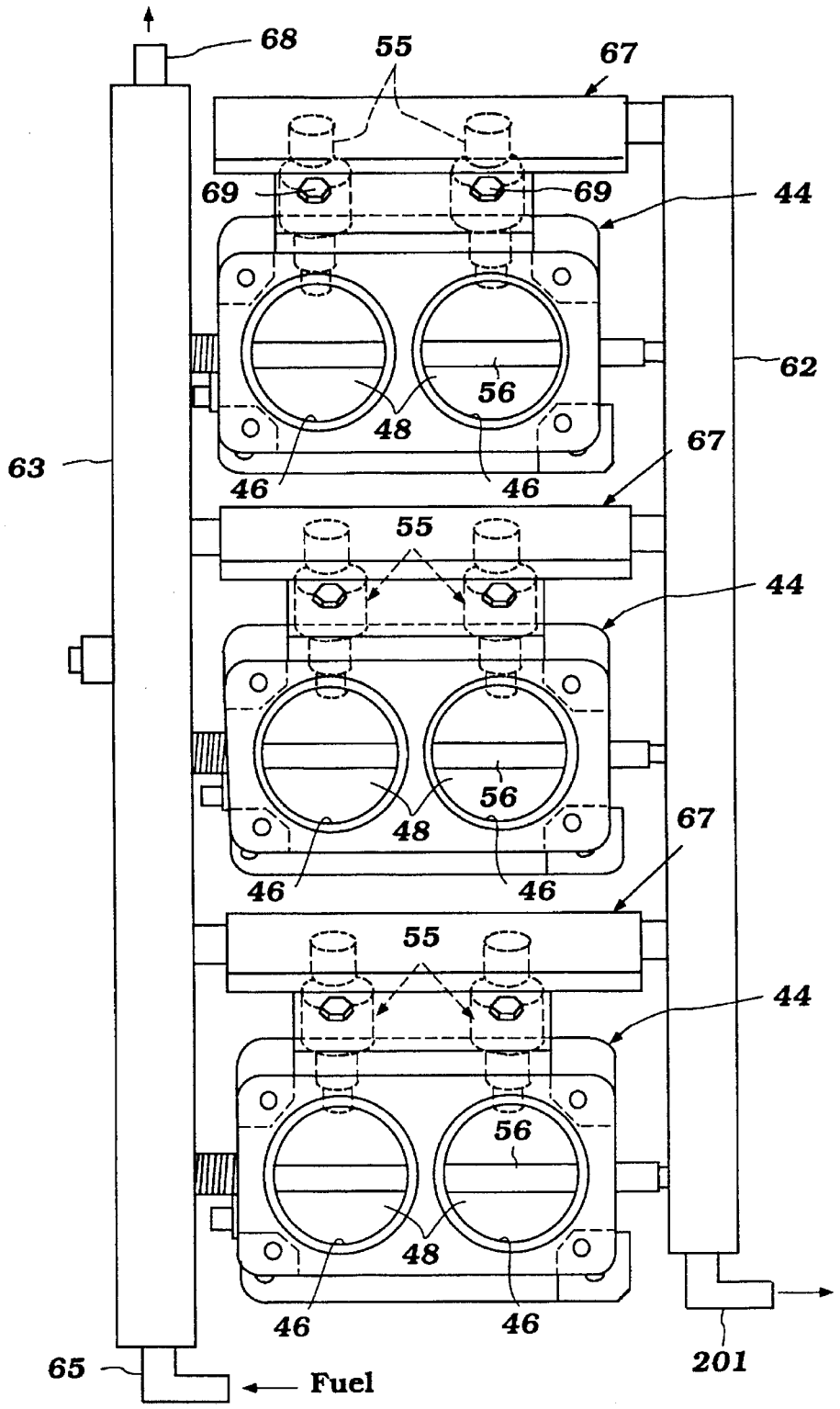
FIG. 12 is a view taken in the direction of the arrow 12 in FIG. 11 and is similar, in part, to FIGS. 4 through 6, and 8 through 10.

FIGS. 11 and 12 show a further embodiment and this embodiment differs from each of the previously described embodiments in that it mounts the fuel injectors 55 so that their lower ends pass into a series of parallel bores 181 formed in the intake manifold 49 rather than in the throttle body. However, since the intake manifold 49 and throttle body sections 44 are affixed to each other, there will still be rigidity of mounting. Again, the individual cross-manifolds, indicated again by the reference numerals 67, are affixed to the throttle body sections 44 by the threaded fastener 69 so as to provide a rigid attachment.

This embodiment differs form the previous embodiments in the fuel manifolding arrangement as shown in FIG. 12. This embodiment, like some of the previously described embodiments, uses a pair of side manifold sections 62 and 63, but in this embodiment only the side manifold 63 has an inlet fitting 65. Hence, the manifold section 63 is served through the cross-manifold section 67. It is, however, provided with its own discharge passage 201 which communicates with the same or a similar regulator as the discharge fitting 68 from the manifold section 63.

From the foregoing description, it should be readily apparent that the described embodiments of the invention provide a very effective fuel manifold arrangements for multiple cylinder and, particularly, V-type engines having multiple cylinder with pairs of fuel injectors. In addition, the mounting arrangements for the injectors are such that the fuel injectors will be relatively rigidly mounted and cannot easily work free from either the manifold or throttle body, whichever they cooperate with.

Of course, the foregoing description is that of preferred embodiments of the invention, and various changes and modifications may be made without departing from the spirit and scope of the invention, as defined by the appended claims.

I claim:

1. A fuel injection system for an internal combustion engine having a throttle body assembly with a plurality of pairs of induction passages, a plurality of pairs of fuel injectors each mounted in said throttle body assembly and disposed to spray fuel into a respective induction passage, and a fuel supply system for supplying fuel to said fuel injectors, said fuel supply system comprising a first manifold section extending along one side of at least some of said induction passages for supplying fuel to the fuel injectors associated with those induction passages, and a second manifold section spaced from said first manifold section and extending along another side of said induction passages for supplying fuel to the fuel injectors associated with the other induction passages.

2. A fuel injection system for an internal combustion engine as set forth in claim 1, further including means for supplying fuel from the first manifold section to the second manifold section.

3. A fuel injection system for an internal combustion engine as set forth in claim 1, wherein the second manifold section extends perpendicularly to the first manifold section.

4. A fuel injection system for an internal combustion engine as set forth in claim 3, wherein there are a plurality of second manifold sections each associated with a respective pair of induction passages and each serving the paired fuel injectors associated therewith.

5. A fuel injection system for an internal combustion engine as set forth in claim 4, further including means for supplying fuel from the first manifold section to the second manifold sections.

6. A fuel injection system for an internal combustion engine as set forth in claim 1, wherein the first manifold section extends along the same side of all of the pairs of induction passages.

7. A fuel injection system for an internal combustion engine as set forth in claim 6, wherein the second manifold section extends perpendicularly to the first manifold section.

8. A fuel injection system for an internal combustion engine as set forth in claim 7, wherein there are a plurality of second manifold sections each associated with a respective pair of induction passages and each serving the paired fuel injectors associated therewith.

9. A fuel injection system for an internal combustion engine as set forth in claim 1, wherein the first and second manifold sections extend along opposite sides of the pairs of induction passages.

10. A fuel injection system for an internal combustion engine as set forth in claim 9, wherein the pairs of fuel injectors are disposed on the same sides of the induction passages as the respective manifold sections and receive fuel directly therefrom.

11. A fuel injection system for an internal combustion engine as set forth in claim 10, wherein each manifold section is provided with a respective fuel inlet fitting and a fuel outlet fitting, the fuel inlet fitting communicating with a source of a fuel under pressure and the fuel outlet fittings being associated with a pressure regulator.

12. A fuel injection system for an internal combustion engine as set forth in claim 11, wherein the inlet and outlet fittings of the manifold sections are formed at the same ends of the manifold sections.

13. A fuel injection system for an internal combustion engine as set forth in claim 12, wherein the manifold sections extend in a vertical direction and the return fittings are disposed at the upper ends thereof.

14. A fuel injection system for an internal combustion engine as set forth in claim 10, further including a series of cross-manifold sections extending between the first and second manifold sections and each serving a respective pair of fuel injectors.

15. A fuel injection system for an internal combustion engine as set forth in claim 14, wherein the fuel injector pairs are all disposed on the same side of the induction passages and the cross-manifold sections directly serve the respective pairs of fuel injectors.

16. A fuel injection system for an internal combustion engine as set forth in claim 15, further including means for providing a direct source of fuel under pressure to each of the first and second manifold sections.

17. A fuel injection system for an internal combustion engine as set forth in claim 15, further including means for providing a restriction in the cross-manifold sections between the pair of fuel injectors served thereby for reducing pressure fluctuations there between.

18. A fuel injector throttle body assembly comprising a throttle body forming an induction passage, a butterfly type throttle valve within said induction passage and supported for rotation therein upon a throttle valve shaft journaled in said throttle body, a fuel injection nozzle having a nozzle portion received in an opening in the throttle body intersecting the induction passage, a fuel rail detachably affixed to said fuel injector for supplying fuel thereto, and means for rigidly affixing said fuel rail directly to said throttle body.

* * * * *